United States Patent [19]

Bennett

[11] Patent Number: 4,597,438

[45] Date of Patent: Jul. 1, 1986

[54] SWIVEL BAR APPARATUS FOR USE WITH STEEL AND OTHER TYPES OF SUCKER RODS

[76] Inventor: Donald W. Bennett, P.O. Box 6808, Odessa, Tex. 79762

[21] Appl. No.: 537,870

[22] Filed: Sep. 30, 1983

[51] Int. Cl.[4] ..... E21B 43/00

[52] U.S. Cl. ..... 166/105; 166/369; 76/101 E

[58] Field of Search ..... 52/734, 737, 739, 740, 52/726; 166/105, 369; 403/383, 404; 29/505; 76/101 E; 175/320

[56] References Cited

U.S. PATENT DOCUMENTS

| | | | |
|---|---|---|---|
| 1,635,658 | 7/1927 | Boardman | 52/740 |
| 1,813,015 | 7/1931 | Bell | 76/101 E |
| 2,139,077 | 12/1938 | Gray | 76/101 E |
| 2,315,414 | 3/1943 | Germany | 76/101 E |
| 2,652,231 | 9/1953 | Smith | 175/320 |

FOREIGN PATENT DOCUMENTS

| | | | |
|---|---|---|---|
| 954038 | 9/1974 | Canada | 166/105 |

*Primary Examiner*—Stephen J. Novosad
*Assistant Examiner*—M. Goodwin
*Attorney, Agent, or Firm*—Fulbright & Jaworski

[57] ABSTRACT

A new and improved sinker bar has a substantial portion of its body square in cross section which increases rigidity and decreases wall to wall contact downhole in the production of fluids utilizing a sucker rod string. In addition, when the bars are used with a certain percentage of sucker rods, a greater efficiency and thus reduction of friction is accomplished in production of the fluids downhole.

2 Claims, 3 Drawing Figures

SWIVEL BAR APPARATUS FOR USE WITH STEEL AND OTHER TYPES OF SUCKER RODS

BRIEF DESCRIPTION OF THE PRIOR ART, IMPROVEMENTS OVER THE PRIOR ART AND DRAWINGS

The present invention relates to a new and improved sinker bar for use with sucker rods and a string for the production of fluids with a sinker bar and sucker rods comprising a string as that term is known for the production of fluids at the bottom of a well bore with a mechanical downhole pump. It is known to use, for example, 60% fiberglass sucker rods and 40% steel rods positioned on the bottom of such fiberglass sucker rods to cause the fiberglass sucker rod string to stretch at the end of the downstroke from the surface such that 100 inches of stroke at the surface of the well bore might well be 150 inches at the bottom of the hole. The invention is not limited to this example, however. On the return upstroke the fiberglass rods on the bottom and the mechanical pump attached to the end thereof might travel an additional 50 inches to produce a substantially increased amount of fluid because of the added length of the stroke.

While this method has advantages with respect to increased production of fluid, its disadvantages are many because the over-all total length of the string is continually under compression on the downstroke and continually under tension on the upstroke. Further, it is to be understood that while such a combination of a sucker rod string of steel and fiberglass or something lighter than steel creates overall less weight on the string and thus less energy requirements at the surface to move the string upwardly and downwardly to produce fluids, that the ultimate efficient combination would be to concentrate all the weight immediately above the downhole mechanical pump. Thus the ultimate objective for the most efficient use of fiberglass rods or steel rods or rods lighter than steel for the production of fluids downhole (rather than the objective of attempting to obtain greater fluid production) is to provide the minimum weight to overcome forces in the well bore system so that the maximum weight of the combination sucker rod string and sinker bars is immediately above the mechanical pump and the minimum weight is at the well bore surface. In this way, frictional losses are minimized and the center of gravity is concentrated over the downhole mechanical pump so that a substantial amount of rubbing of the sucker rod string against the tubing is eliminated. In the prior art, the following patents are considered relevant:

U.S. Pat. Nos. 901,282; 1,064,764; 1,689,281; 2,244,104; 2,266,357; 2,652,231; 2,825,752; 2,863,704; 2,874,927; 2,874,938; 2,948,231; 3,018,140; 3,461,539; 3,534,989; 3,549,791; 3,661,388; 3,737,556; 4,024,913; 4,127,741; 4,195,691; 4,198,538; 4,205,926; 4,315,699: Canada No. 1072191: Fed. Rep. of Germany No. 2511809: France No. 1210779: United Kingdom No. 681550.

Further, your Applicant has found that the use of a square sinker bar has several advantages. It is known that sinker bars are used to attempt to concentrate the weight down near the bottom of the sucker rod string to eliminate the friction or rubbing of sucker rods up and down against the well bore. In the prior art, such sinker bars were round and it was desired to always keep the sucker rod string in tension. To accomplish that a heavier circular bar was used or a greater number of smaller circular bars was used. The bar was notched for a wrench flat to enable making up and disassambling of the sinker bar with the steel sucker rod string, but obviously such cutting into the bar created a stress area.

Applicant's design is a square sinker bar with radiused corners producing increased rigidity downhole and additional weight per foot. Additionally there is an area provided for a wrench flat for assembly and disassembly of the sinker bars from the sucker rod string, but the area for the wrench flat does not produce any substantial loss of rigidity in such suker bar. In addition, connections for the sinker bar are female to female or male to male connections which when assembled with a coupling provide four pressure interlocking faces for box to box connection.

While some of the advantages of the present invention over the prior art have been described, and while the specifications set forth hereinbelow are designed to set forth Applicant's preferred embodiment, it is to be understood that other embodiments of Applicant's invention may be encompassed by the claims appended hereto, and that such specifications set forth hereinbelow sets forth Applicant's best mode of his invention at the present time.

DETAILED DESCRIPTION OF THE INVENTION

Figure 1:
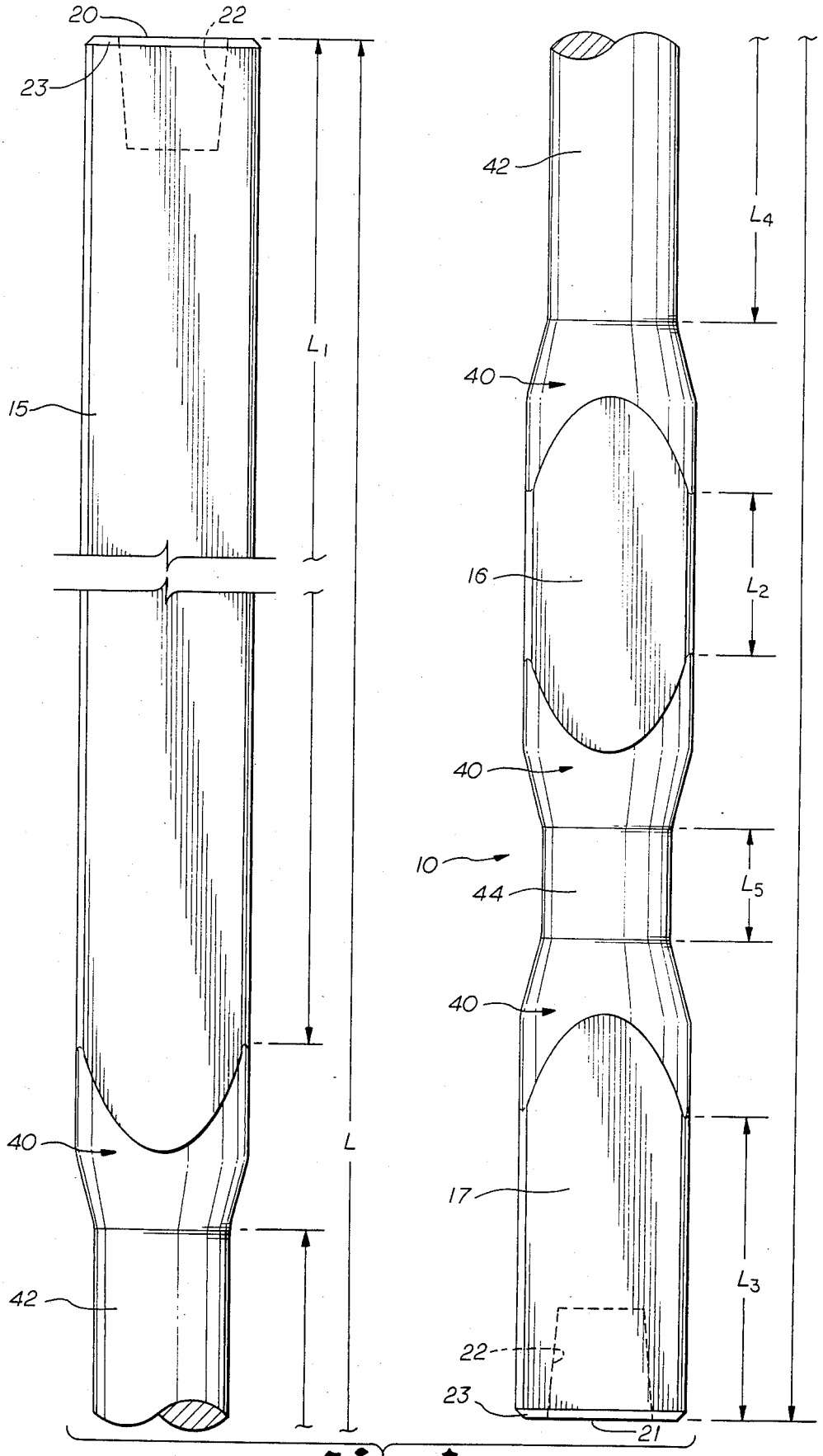
FIG. 1 is a detailed view of the sinker bar of the present invention.
Figure 2:
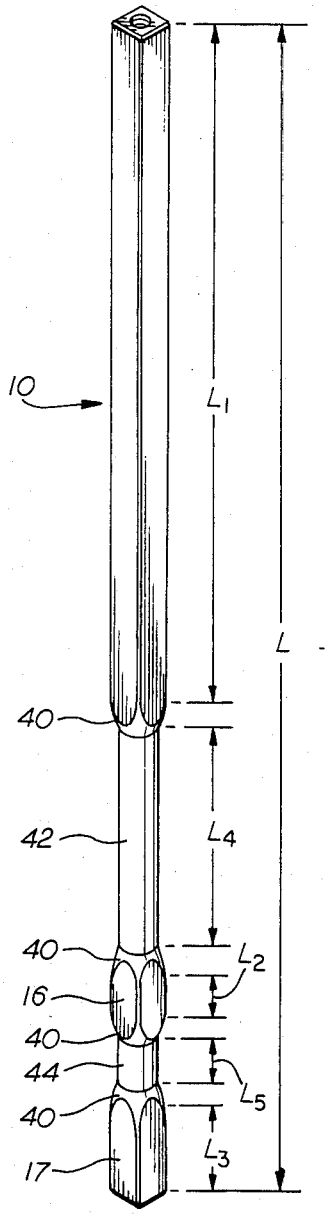
FIG. 2 is a perspective view of Applicant's sinker bar of the present invention; and, FIG. 3 is an overall perspective view of Applicant's bar used in a well bore with other sucker rods for purposes of illustration of the use of Applicant's invention.

As illustrated in FIGS. 1 and 2, the sinker bar of the present invention is generally designated by the numeral 10 and normally has an overall length L of 24 feet. The bar 10 has a square cross section for a substantial portion of its length. Lengths L1, L2 and L3 as illustrated in FIGS. 1 and 2 have a square cross section. Normally length L1 will be inserted first into a well bore.

As illustrated in FIGS. 1 and 2, only the square surface areas 15, 16 and 17 associated with L1, L2 and L3 respectively are illustrated, it being understood that such surfaces represent flat surfaces of those portions of the bar having a square cross section. As further illustrated in FIG. 1, adjacent each end 20 and 21 are machined female threads 22 which extend inwardly, as shown by the dotted lines, into the ends 20 and 21 respectively with each end 20 and 21 being a flat surface. A bevelled area 23 is provided around the outer periphery of such flat surfaces 20 and 21. The bevel or scallop area 23 of the surfaces 20 and 21 permits a pressure interlocking of surfaces on adjacent bars when bars are mated end to end with suitable pin to pin connection (not shown). A pin-pin assembly technique can also be used with standard couplings. It is to be understood that the square cross sectional configuration of lengths L1, L2 and L3 renders the sinker bar more rigid than the typical circular prior art bars. Because of the square corners, there is less contact area if rubbing of the bars against the tubing string occurs, thus reducing normally encountered drag and friction.

As further illustrated in FIGS. 1 and 2, lengths L4 and L5 are machined with a substantially circular cross section. The exterior areas of the bar 10 between L1 and L4; L4 and L2; L2 and L5; and L5 and L3 are tapered toward the immediately adjacent portions of the bar with circular cross sections. The surfaces 42 and 44 are sufficiently separated so that the square area 16 can serve as a "flat" for wrenching and disconnecting or connecting the sucker rods. The areas 42 and 44 also provide suitable elevator neck and transfer slot areas as for enabling manipulation of the bars 10.

Figure 3:
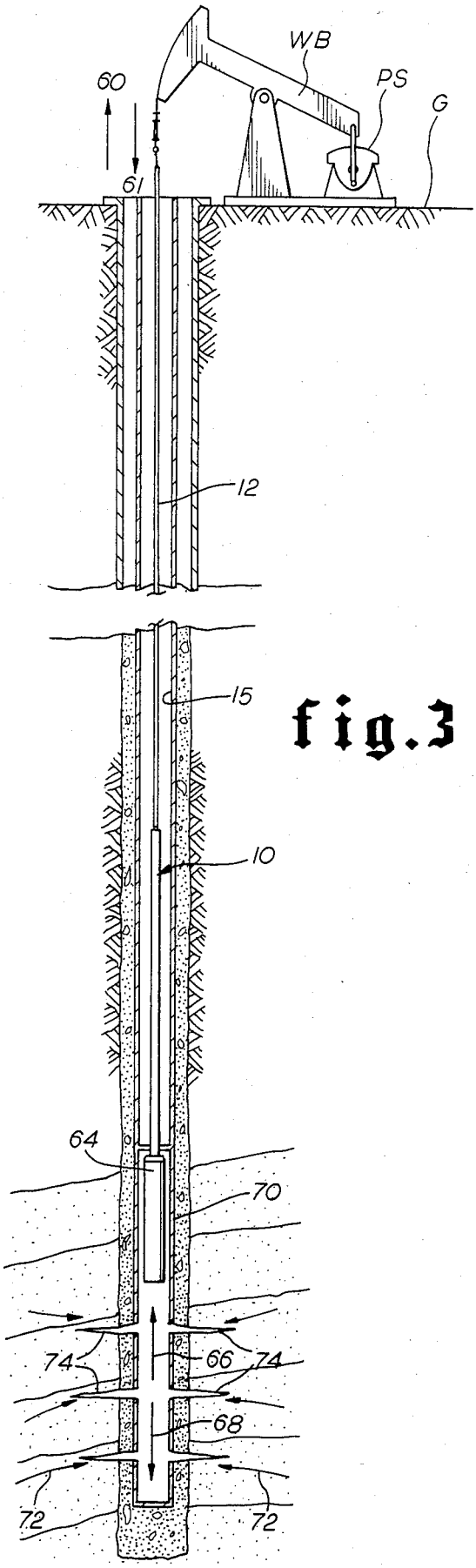

As illustrated in FIG. 3 the sinker bars are used with sucker rods 12; the rods 12 may be of steel, iron or of any material lighter than steel or iron. The object is to determine the minimum weight necessary to overcome forces such as friction created by the rubbing of the rod string up against the side of the well bore 15. A typical installation is illustrated with a power source PS positioned on or adjacent the ground G for moving a walking beam WB upwardly and downwardly in the direction of the arrows 60, 61. The downhole pump 64 moves upwardly or downwardly in the direction of the arrow 66, 68. The downhole pump 64 moves fluid upwardly in the well bore in the direction of the arrow 66 when the walking beam WB moves upwardly. Simultaneously the bar 10 and sucker rod 12 also move upwardly. The tubing string 70 is usually perforated so that the well bore can communicate with the surrounding formation. The arrows 72 indicate perforating through suitable ports 74 to enable fluid to enter into the tubing string.

For a sucker rod string constructed of 60% fiberglass rods and 40% steel rods, 4,000 feet of steel rods would be required in a 10,000 foot string. The energy requirements at the surface to overcome the downhole friction forces of such a string are enormous. Less energy is required when only two to four bars 10 are used according to the present invention. In a sucker rod string for a 10,000 foot well only five to fifteen percent of the total sucker rod string must be sinker bars according to the present invention. By placing the sinker bars 10 immediately above the mechanical pump the center of gravity of the complete string is immediately above the pump. This positioning of the bars prevents deviation, curling, rubbing and wobbling of the string. Further, concentration of the weight immediately above the pump reduces friction pull.

Another type of friction encountered in the well bore is the viscous friction of the hydrostatic head or fluid that is desired to be lifted. The depth of the well determines the amount of bars used. As an additional safety factor more bars can be used. The pump must move upwardly and downwardly throuh wall to wall contact against the weight of the hydrostatic head and the like. Thus, it has been found that the sinker bar weight calculation is a function of the rod size, the hydrostatic head, the well depth, the safety factor and the friction force from the pump. A multiple of such factors determines the minimum sinker bar weight to overcome forces in the pump, but yet maximum efficiency to move fluid up the well bore while at the same time reducing torque and drag immediately above the pump. With the use of Applicant's rigid square sinker bars positioned directly above the pump a substantial amount of rub and friction against the side of the well bore is eliminated and the rod string's center of gravity is located immediately above the pump.

While the invention and specific embodiment have been disclosed in Applicant's invention in FIGS. 1–3, it is to be understood that Applicant's invention is not limited to the embodiment disclosed and may contain and relate to other embodiments; however, the appended claims are intended to cover the full scope of Applicant's invention including, but not limited to, the specific embodiments illustrated in FIGS. 1–3.

What is claimed is:

1. A sinker bar for use in a well bore with a plurality of sucker rods, the sinker bar comprising;

an elongated body member of suitable diameter for introduction into the well bore or into tubular members lining the well bore, at least half of the body member having a substantially square cross section and each end of the body member having a substantially square cross section, and the ends of the body member having connection means for connecting the sinker bar to adjacent members in the well bore.

2. The invention of claim 1 wherein distinct portions of the body member have a substantially square cross section and between such portions the body member has a round cross section.

* * * * *